US012747895B2

(12) United States Patent
Kim et al.

(10) Patent No.: US 12,747,895 B2
(45) Date of Patent: Sep. 29, 2026

(54) COLD WATER TANK ASSEMBLY AND MANUFACTURING METHOD THEREOF

(71) Applicant: COWAY Co., Ltd., Gongju-si (KR)

(72) Inventors: Jae Man Kim, Gongju-si (KR); Woong Jung, Gongju-si (KR)

(73) Assignee: COWAY Co., Ltd., Gongju-si (KR)

( * ) Notice: Subject to any disclaimer, the term of this patent is extended or adjusted under 35 U.S.C. 154(b) by 64 days.

(21) Appl. No.: 18/953,199

(22) Filed: Nov. 20, 2024

(65) Prior Publication Data

US 2025/0164162 A1 May 22, 2025

(30) Foreign Application Priority Data

Nov. 21, 2023 (KR) ..... 10-2023-0161946

(51) Int. Cl.
*F25B 39/02* (2006.01)
*F25B 41/40* (2021.01)

(52) U.S. Cl.
CPC ..... *F25B 39/02* (2013.01); *F25B 41/40* (2021.01); *F25B 2339/041* (2013.01); *F25B 2700/21* (2013.01)

(58) Field of Classification Search
CPC ..... F28D 7/026; F28D 7/024; F28D 1/0213; F28D 1/02; F25B 2700/21
See application file for complete search history.

(56) References Cited

U.S. PATENT DOCUMENTS 3,907,025 A * 9/1975 Malcosky ..... F24F 1/0373 165/146
4,373,354 A * 2/1983 Sawyer ..... F24D 17/02 62/324.4
2019/0063799 A1* 2/2019 Lutterbach ..... F25B 25/005

FOREIGN PATENT DOCUMENTS

| | | | |
|---|---|---|---|
| JP | 60-33489 | A | 2/1985 |
| JP | 2-169992 | A | 6/1990 |
| JP | 11-115994 | A | 4/1999 |
| KR | 10-1658496 | B1 | 9/2016 |
| KR | 10-2019-0078916 | A | 7/2019 |
| KR | 10-2020-0008263 | A | 1/2020 |

(Continued)

OTHER PUBLICATIONS

Japanese Notice of Allowance dated Mar. 3, 2026, in corresponding Japanese Patent Application No. 2024-196903 (with English Translation), 5 pages.

(Continued)

*Primary Examiner* — Lionel Nouketcha
(74) *Attorney, Agent, or Firm* — Oblon, McClelland, Maier & Neustadt, L.L.P.

(57) ABSTRACT

A method for manufacturing a cold water tank assembly according to an aspect of the present invention may include a cold water tank preparation step, an evaporator preparation step, a partition wall preparation step, a first assembly step, a second assembly step, and a third assembly step. A cold water tank assembly according to another aspect of the present invention may include a cold water tank including a body and a cap; an evaporator including a spiral shaft tube and a spiral tube extending to forming a plurality of turns of first spirals at a set pitch around the spiral shaft tube; and a partition wall including a shaft body and a partition extending to form a plurality of turns of second spirals at a set pitch around the shaft body.

20 Claims, 10 Drawing Sheets

FIG. 2

(56) References Cited

FOREIGN PATENT DOCUMENTS

WO WO-2016094107 A1 * 6/2016 ..... F25D 1/002

OTHER PUBLICATIONS

European search report (under R. 61 or R. 63 EPC) issued Apr. 17, 2025, in corresponding European Patent Application No. 24214126.5, 4 pages.

* cited by examiner

COLD WATER TANK ASSEMBLY AND MANUFACTURING METHOD THEREOF

CROSS-REFERENCE TO RELATED APPLICATION

This application claims priority to and the benefit of Korean Patent Application No. 10-2023-0161946, filed on Nov. 21, 2023, the disclosure of which is incorporated herein by reference in its entirety.

TECHNICAL FIELD

The present invention relates to a cold water tank assembly and a manufacturing method thereof, and more particularly, to a cold water tank assembly capable of increasing the amount of cold water extraction by maximizing heat exchange efficiency while miniaturizing, and a manufacturing method thereof.

RELATED ART

In general, water purifiers, carbonated water machines, and cold and hot water dispensers are equipped with cold water tanks to cool purified water at room temperature to generate low-temperature purified water (water) and supply it to users.

Taking a water purifier as an example, such a cold water tank includes an inlet pipe and an outlet pipe to communicate with the inner space, and purified water at room temperature filtered through one or more filters is introduced and stored in the inner space.

In addition, the purified water (water) at room temperature stored through an evaporator (cooling pipe) provided in the cold water tank is cooled to a set temperature and extracted as purified water (water) at a low temperature so that users can drink or use purified water (water) at a temperature lower than room temperature.

For example, Korean Registered Patent Registration No. 10-1658496 discloses a structure in which an evaporator (cooling pipe) is wrapped in an indirect cooling method on the outer circumferential surface of a cylindrical cold water tank to cool stored purified water.

However, in the case of such a cold water tank, as the evaporator is arranged to surround the outer circumferential surface of the cold water tank, there was a problem in that the chilliness of the evaporator is not transmitted only to the cold water tank, but is discharged outside, resulting in poor cooling efficiency.

In addition, ice is created around the evaporator as the temperature drops, and as the ice is formed outside the cold water tank, water created by melting the ice flows outside the cold water tank and affects other components (modules) of the water purifier.

Meanwhile, in order to solve this problem, a structure that cools the stored purified water by providing a cooling unit (evaporator, cooling pipe) in the inner space of the cold water tank has also been disclosed, as in Korean Patent Laid-Open Publication No. 10-2020-0008263.

However, such a cold water tank has a cooling unit arranged on an extended internal space without a partition wall, resulting in a problem that the overall cooling efficiency is reduced due to the different cooling rates between the purified water at the location close to the cooling unit and the purified water at the location far from the cooling unit.

Furthermore, as the current water purifier seeks more miniaturization, these cold water tanks have poor cold water efficiency (the value obtained by dividing the cold water extraction amount by the tank capacity), and thus, there is a problem in that the user's satisfaction is poor because it is difficult to quickly obtain as many low-temperature purified water as the user wants.

Meanwhile, the evaporator placed inside or outside the cold water tank is usually made of metal, and its shape is already determined through a bending process before it is combined with the cold water tank, and after the shape is determined, it is placed in the cold water tank through an electrolytic polishing process for surface polishing.

This electrolytic polishing process serves as a coating while removing fine scratches or contamination on the outer circumferential surface of the evaporator, preventing possible foreign substances from entering the cold water tank or rusting of the evaporator.

However, for the conventional cold water tank, the process of re-bending the evaporator part after the electrolytic polishing process is also performed for stable arrangement of the evaporator's internal accommodation space and connection with other external connection flow paths.

In this case, there may be a problem that cracks may occur in the post-bending part of the evaporator (the bent and folded part), and scratches and fine foreign substances caused by cracks may penetrate into the cold water tank and be included in the purified water.

In addition, in the case of an evaporator placed in the internal accommodation space of a cold water tank, problems such as rust may occur along with penetration of foreign substances as the crack occurrence point is always in contact with purified water (water).

Accordingly, in constructing a cold water tank in a water purifier, etc., there is an urgent need for a cold water tank assembly and a manufacturing method thereof capable of maximizing heat exchange efficiency while miniaturizing and increasing the amount of cold water extraction, thereby increasing user satisfaction, as well as capable of optimally exhibiting the original function of a cold water tank by completely blocking the intrusion of foreign substances into the extracted purified water.

SUMMARY

The present invention aims to solve the above problems, and the present invention is directed to providing a cold water tank assembly and a manufacturing method thereof capable of maximizing heat exchange efficiency while miniaturizing and increasing the amount of cold water extraction, thereby increasing user satisfaction, as well as capable of optimally exhibiting the original function of a cold water tank by completely blocking the intrusion of foreign substances into the extracted purified water.

In addition, the present invention is also directed to providing a cold water tank assembly and a manufacturing method thereof that can block the occurrence of cracks and rust in the evaporator placed inside the cold water tank by eliminating the post-bending process for the evaporator.

In addition, the present invention is also directed to providing a cold water tank assembly and a manufacturing method thereof that can maximize the amount of cold water extraction by applying a spiral evaporator and a spiral partition wall part structure inside the cold water tank while miniaturizing the size compared to the conventional cold water tank capacity.

In addition, the present invention is also directed to providing a cold water tank assembly and a manufacturing method thereof that can minimize the design space of a water purifier by maximizing the cold water efficiency (the value obtained by dividing the cold water extraction amount by the tank capacity) compared to the cold water tank capacity and miniaturizing it.

The problems of the present invention are not limited to those mentioned above, and other problems not mentioned will be clearly understood by those of ordinary skill in the art from the following description.

The objects of the present disclosure are not limited to the above-described objects, and other objects that are not mentioned will be able to be clearly understood by those skilled in the art to which the present disclosure pertains from the following description.

According to an aspect of the present invention, a method for manufacturing a cold water tank assembly is provided.

The method for manufacturing a cold water tank assembly is a method for manufacturing a cold water tank assembly in which purified water at room temperature passes through N heat exchange chambers having a spiral orbit and is extracted as purified water at low temperatures, and the method may include preparing a cold water tank, including: preparing a cylindrical body part having an open entrance and an internal accommodation space, and preparing a cap part configured to seal the open entrance of the body part; preparing an evaporator, including: preparing an evaporator having a spiral shaft tube having a set length and a spiral tube that forms N turns of first spirals along the length at a set pitch around the spiral shaft tube by bending one side of the spiral shaft tube, and has an extension line extending without bending at an end to have directionality in a first direction or second direction, and performing an electrolytic polishing process on the evaporator; preparing a partition wall part, including: preparing a tubular shaft body with a set length and a partition wall part that has a plate shape extending in the first direction and the second direction around the shaft body and forms a partition extending in a third direction while forming N turns of second spirals at a set pitch; assembling a first assembly, including: positioning a lower hole of the shaft body on an upper end of the spiral shaft tube, and rotating and assembling the evaporator or partition wall part so that the spiral shaft tube passes through the shaft body and the spiral tube passes between the partitions; assembling a second assembly, including: fastening a flange in which the flange is thermally fused to one side of the spiral shaft tube and one side of the spiral tube, and assembling the cap part to the first assembly so that the spiral shaft tube and the spiral tube pass through the cap part and then are exposed to the outside; and assembling a cold water tank assembly, including: inserting and arranging the second assembly into the accommodation space of the body part to form N heat exchange chambers in the accommodation space of the body part.

In addition, the method may further include post-assembling including: mounting a temperature sensor to the cap part of the cold water tank assembly, and bending one side of the spiral shaft tube and one side of the extension line of the spiral tube that pass through the cap part and are placed outside the cold water tank.

In this case, in the rotating and assembling, the extension line of the spiral tube may be assembled while sequentially passing through between the partitions that form the second spiral.

In this case, in the assembling a first assembly, the spiral tube may be assembled so that a first distance from a partition placed at a lower portion of the heat exchange chamber is equal to or smaller than a second distance from a partition placed at an upper portion of the heat exchange chamber.

In this case, the cap part may include a first hole into which a first flange fused to the spiral shaft tube is closely fitted, and a second hole into which a second flange fused to the spiral tube is closely fitted.

In addition, the assembling a second assembly may further include a screw fastening process of combining a fastening screw with a thread formed on outer circumferential surfaces of the first flange exposed to the outside of the first hole and the second flange exposed to the outside of the second hole, respectively.

According to another aspect of the present invention, a cold water tank assembly is provided.

The cold water tank assembly may include a cold water tank including: a body part having a cylindrical shape with an inlet pipe and an outlet pipe through which purified water flows, having an entrance expanded in a first direction and second direction and a set length in a third direction, and having an accommodation space formed therein, and a cap part configured to seal the entrance; an evaporator through which refrigerant flows, including a spiral shaft tube placed in the accommodation space in the third direction, and a spiral tube in which one end of the spiral shaft tube extends in the third direction while forming N turns of first spirals at a set pitch around the spiral shaft tube; and a partition wall part including: a shaft body arranged to surround the spiral shaft tube, and a partition that has a plate shape extending in the first direction and the second direction around the shaft body and extends in the third direction while forming N turns of second spirals at a set pitch.

In this case, an end edge of the partition may be arranged closely to an inner circumferential surface of the accommodation space of the cold water tank to form N heat exchange chambers as a flow path communicating with the inlet pipe and the outlet pipe in the accommodation space in the third direction.

In addition, the spiral tube may be arranged to pass through the N heat exchange chambers continuously, and after forming the $N^{th}$ first spiral, an extension line thereof that extends without bending for the end to have directionality in the first direction or second direction may be exposed to the outside of the cold water tank.

In this case, the body part may include an inner cylinder configured to accommodate the evaporator and the partition wall part; and an outer cylinder configured to surround the inner cylinder and form a space.

In this case, the body part may have a circular cross-section, or a cross-sectional shape of a closed surface having a long axis in the first direction and a short axis in the second direction orthogonal to the first direction.

In this case, the extension line may be formed longer than the radius of the second spiral of the partition so that it is exposed to the outside of the cold water tank.

In this case, the pitch of the spiral tube and the pitch of the partition may be formed to be equal.

In this case, the cap part may include a first hole into which a first flange fused to the spiral shaft tube is closely fitted, and a second hole into which a second flange fused to the spiral tube is closely fitted. In addition, the first flange and the second flange may further include a sealing member along one side in contact with the cap part.

Meanwhile, part or all of the partition may be formed of a soft material and the end edge may be disposed to press the inner circumferential surface of the accommodation space of the body part.

In addition, the cold water tank may further include a separation spacer that has a plurality of support ribs and is arranged to be spaced apart from a lower bottom surface of the accommodation space so that one upper side is in contact with an end of the evaporator.

In this case, for example, the separation spacer may include a ring-shaped first support; a ring-shaped second support surrounding the first support; and the plurality of support ribs radially arranged connecting the first support and the second support in a plate shape.

Meanwhile, the cap part may include a plate body having a size enough to cover the entrance of the body part; a first wall protruding downward in the third direction so that a part of the plate body is in contact with an upper inner circumferential surface of the body part; and a second wall protruding downward in the third direction so that another part of the plate body is spaced apart from the first wall and is in contact with an upper outer circumferential surface of the body part.

In this case, the cap part may be coupled to seal the entrance of the body part in the third direction. In addition, the first wall, the upper end edge of the body part, and the second wall may form a sealing space therebetween, and a packing member may be provided in the sealing space.

In this case, the plate body may form a convex round surface upward in the third direction.

In this case, the cap part may further include, at one side, a temperature sensor passing through and hermetically coupled to the plate body.

In this case, the temperature sensor may have a length and be arranged to pass through a set number of the partitions from the top of the body part to downward in the third direction.

Meanwhile, the cap part may include, at one side, an inlet pipe through which purified water at room temperature flows in, the inlet pipe configured to communicate with the first heat exchange chamber of the accommodation space.

In addition, the body part may include, at the bottom surface, an outlet pipe that communicates the $N^{th}$ heat exchange chamber of the accommodation space and extracts purified water at low-temperature.

According to the above configuration, the cold water tank assembly and the manufacturing method thereof according to the present invention combines the evaporator placed inside the cold water tank in contact with purified water (water) as it was initially manufactured, and after it is combined, there is no post-bending process inside the cold water tank, so it is possible to prevent cracks and rust occurrence due to post-bending.

In addition, as it partitions the accommodation space inside the cold water tank into a plurality of (N) heat exchange chambers that continuously communicate with each other using the spiral evaporator and the spiral partition wall part, the introduced purified water sequentially passes through the N heat exchange chambers (H/A), heat-exchanging, thereby capable of maximizing heat exchange efficiency and cooling the purified water at room temperature to low-temperature purified water (cold water) with a set temperature in a short time.

In addition, as the cylindrical accommodation space is formed to make a plurality of (N) heat exchange chambers to have a spiral shape through the spiral evaporator and the spiral partition wall part, the size of the cold water tank can be miniaturized and the amount of cold water extracted can be maximized.

Furthermore, the N heat exchange chambers formed by the spiral evaporator and the spiral partition wall part on the accommodation space of the cold water tank each have a spiral orbit and form a continuous flow path, inducing purified water introduced into the accommodation space through the inlet pipe to have a natural flow without colliding or clogging, thereby increasing the rate of cold water generation while being constant.

In addition, with a structure that forms a plurality of (N) spiral heat exchange chambers through the spiral evaporator and the spiral partition wall part in the accommodation space of the cold water tank, it is possible to minimize the design space of the water purifier by maximizing the cold water efficiency (the value obtained by dividing the cold water extraction amount by the tank capacity) compared to the cold water tank capacity while miniaturizing the overall cold water tank.

Advantageous effects of the present invention are not limited to the above-described effects, and should be understood to include all effects that can be inferred from the configuration of the invention described in the detailed description or claims of the present invention.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
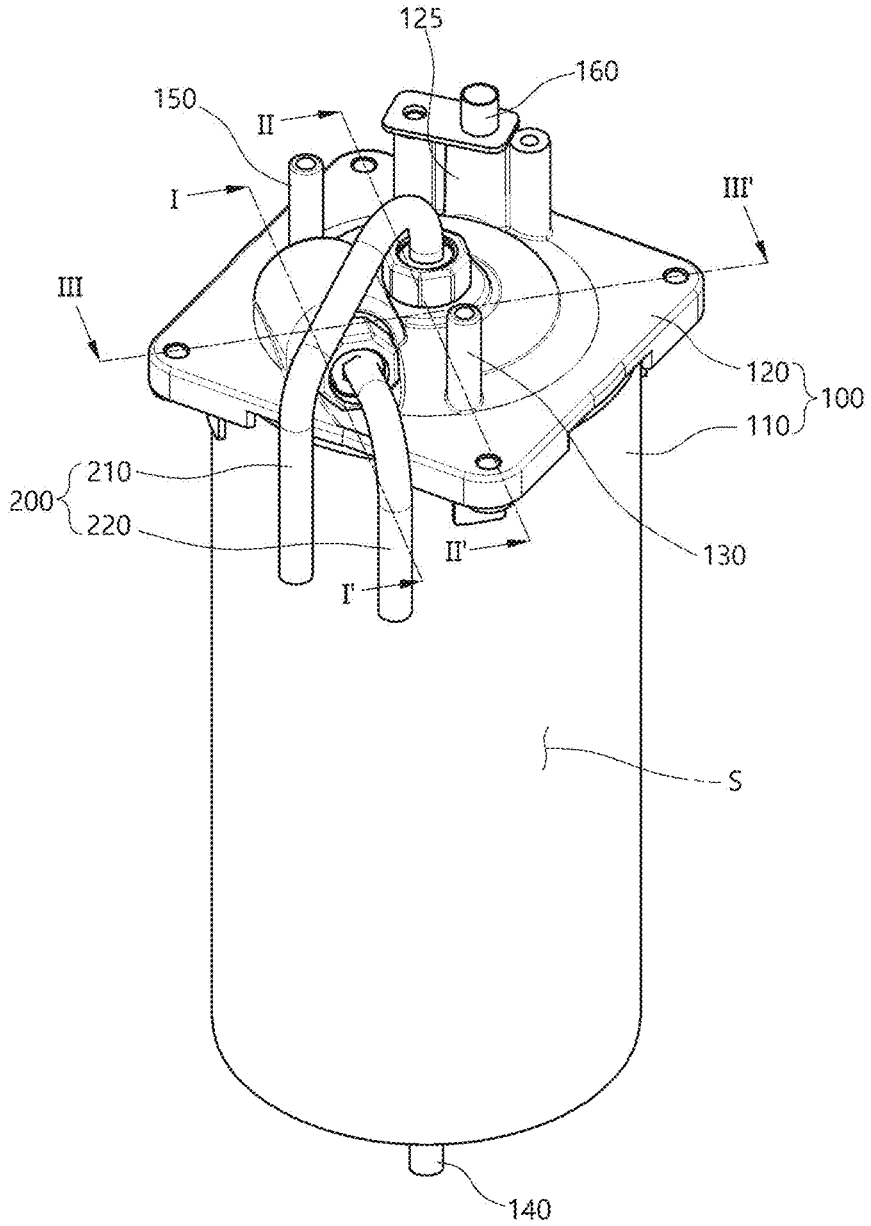
FIG. 1 is a perspective view showing a cold water tank assembly according to an exemplary embodiment of the present invention.

Hereinafter, exemplary embodiments of the present invention will be described in detail so that those of ordinary skill in the art can readily implement the present invention with reference to the accompanying drawings. The present invention may be embodied in many different forms and is not limited to the embodiments set forth herein. In the drawings, parts unrelated to the description are omitted for clarity of description of the present invention, and throughout the specification, same or similar reference numerals denote same elements.

Terms and words used in the present specification and claims should not be construed as limited to their usual or dictionary definition. They should be interpreted as meaning and concepts consistent with the technical idea of the present invention, based on the principle that inventors may appropriately define the terms and concepts to describe their own invention in the best way.

Accordingly, the embodiments described in the present specification and the configurations shown in the drawings correspond to preferred embodiments of the present invention, and do not represent all the technical idea of the present invention, so the configurations may have various examples of equivalent and modification that can replace them at the time of filing the present invention.

It should be understood that the terms "comprise or include" or "have" or the like when used in this specification, are intended to describe the presence of stated features, numbers, steps, operations, elements, components and/or a combination thereof but not preclude the possibility of the presence or addition of one or more other features, numbers, steps, operations, elements, components, or a combination thereof.

The presence of an element in/on "front", "rear", "upper or above or top" or "lower or below or bottom" of another element includes not only being disposed in/on "front", "rear", "upper or above or top" or "lower or below or bottom" directly in contact with other elements, but also cases in which another element being disposed in the middle, unless otherwise specified. In addition, unless otherwise specified, that an element is "connected" to another element includes not only direct connection to each other but also indirect connection to each other.

The terms "X-axis," "Y-axis," and "Z-axis" used in the description will be understood with reference to the coordinate system shown in the drawings. In addition, the description refers to the X-axis direction as the first direction, the Y-axis direction as the second direction, and the Z-axis direction as the third direction, but this is only one example according to a relative perspective, and the first to third directions and coordinate axes (X, Y, Z axes) are introduced to explain the relative positions between components and do not limit the absolute positions of each component.

Additionally, in describing the present invention, detailed descriptions of related known functions or configurations will be omitted in order to not obscure the gist of the present invention.

Furthermore, in describing the present invention, as for a spiral structure, it should be specified in advance that a spiral structure formed by a spiral tube 220 of an evaporator 200 is referred to as a first spiral, and a spiral structure formed by a partition 320 of a partition wall part 300 is referred to as a second spiral and stated in advance. In addition, it should be specified in advance that N or n, which will be described later, means an integer of 1 or more.

Hereinafter, a cold water tank assembly and a manufacturing method thereof according to an exemplary embodiment of the present invention will be described with reference to the drawings.

As shown in FIGS. 1 to 11, a method for manufacturing a cold water tank assembly according to an exemplary embodiment of the present invention proposes a method for manufacturing a cold water tank assembly 1 in which purified water at room temperature passes through N heat exchange chambers (H/A) having a spiral orbit and is extracted as low-temperature purified water.

In this case, the method for manufacturing a cold water tank assembly according to an exemplary embodiment of the present invention is to prevent cracks and rusts caused by post-bending because an evaporator 200, which is placed in an accommodation space (S, FIGS. 1 and 3) inside a cold water tank 100 and is always in contact with purified water (water), is combined with the cold water tank 100 as it was initially manufactured going through an electrolytic polishing process (S22, FIG. 6) and there is no post-bending process for a part of the evaporator 200 that is combined and then placed in the accommodation space S inside the cold water tank 100.

In addition, it is possible to block possible intrusion of foreign substances into the accommodation space S due to the occurrence of cracks.

Meanwhile, as the cold water tank assembly 1 manufactured through this partitions the accommodation space S inside the cold water tank 100 into a plurality of (N) heat exchange chambers H/A (H/A1-H/An) that continuously communicate with each other using the spiral evaporator 200 and the spiral partition wall part 300, the introduced purified water sequentially passes through the N heat exchange chambers H/A, heat-exchanging, thereby capable of maximizing heat exchange efficiency and cooling the purified water at room temperature to low-temperature purified water (cold water) with a set temperature in a short time.

First, the structure and configuration of the cold water tank assembly 1 manufactured through the method for manufacturing a cold water tank assembly according to an exemplary embodiment of the present invention are as follows.

As shown, the cold water tank assembly 1 according to an exemplary embodiment of the present invention largely includes a cold water tank 100, an evaporator 200, and a partition wall part 300.

In this case, the evaporator 200 has a spiral shape, and the partition wall part 300 also has a spiral shape corresponding to the evaporator 200.

The spiral evaporator 200 and the spiral partition wall part 300 are combined through a first assembly step S40 to form one assembly (hereinafter, referred to as a 'first assembly') and are arranged in an accommodation space S inside the cold water tank 100 through a third assembly step S60 to form N (N is an integer of 1 or more) heat exchange chambers H/A connected as a spiral flow path to the accommodation space S of the cold water tank 100.

In this case, the N heat exchange chambers (H/A) also have a spiral structure by the spiral evaporator 200 and the spiral partition wall part 300.

First, the cold water tank 100 constituting the cold water tank assembly 1 according to an exemplary embodiment of the present invention includes an inlet pipe 130 and an outlet pipe 140 through which purified water flows on one side, and includes a body part 110 having an internal accommodation space S so that the evaporator 200 and the partition wall part 300 are arranged, and a cap part 120 coupled to be opened and closed to an entrance 114 (FIG. 3) of the body part 110 to be opened and closed.

For example, the body part 110 of the cold water tank 100 has an entrance expanded in the first direction and the second direction on one side, that is, on the upper side in the drawing, and this entrance has a length set in the third direction and extends to form an accommodation space S.

And the cold water tank 100 preferably has a cylindrical shape so that it can be miniaturized while increasing heat exchange efficiency.

To this end, the body portion 110 preferably has a cylindrical shape. However, it is not limited to the cylindrical shape, and of course it may have a polygonal cylindrical shape as needed. Of course, the entrance may also have a circular or polygonal shape according to the shape of the body part 110.

In other words, of course, the body part 110 may have a circular cross-section, or may have a cross-sectional shape (e.g., elliptical, rectangular, etc.) of a closed surface having along axis in the first direction and a short axis in the second direction orthogonal to the first direction.

Figure 2:
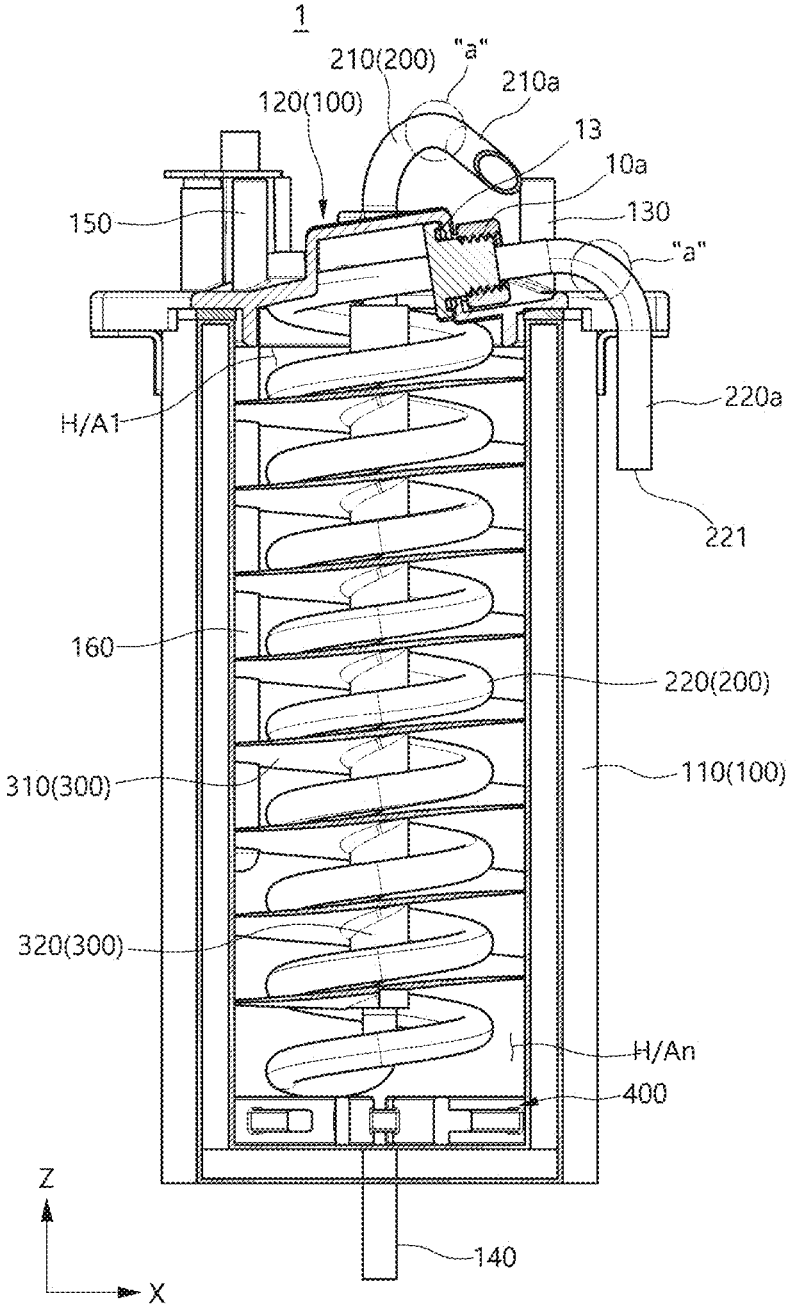
FIG. 2 is a view showing an internal structure through a cross section taken along line I-I' in the cold water tank assembly according to an exemplary embodiment of the present invention.
Figure 3:
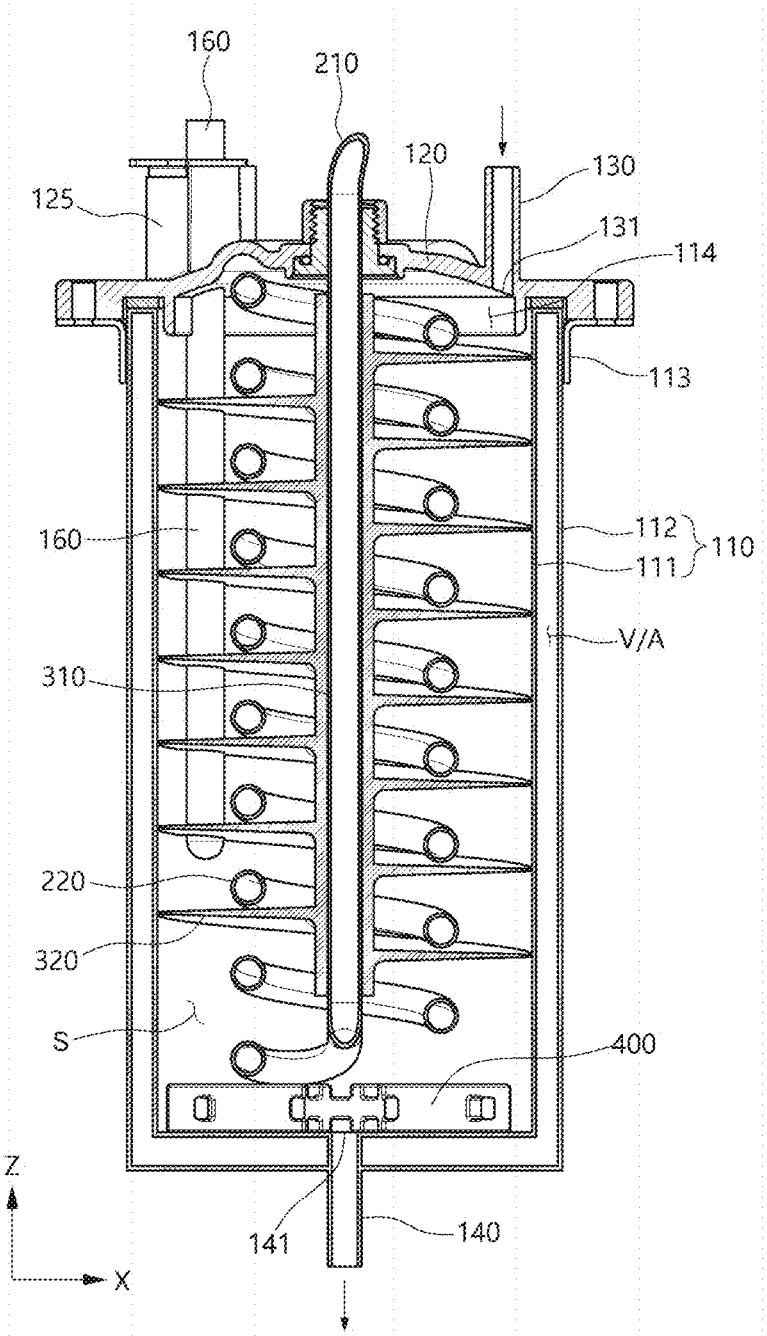
FIG. 3 is a view showing arrangement of an evaporator and a partition wall part through a cross section taken along line II-II' in the cold water tank assembly according to an exemplary embodiment of the present invention.
Figure 4:
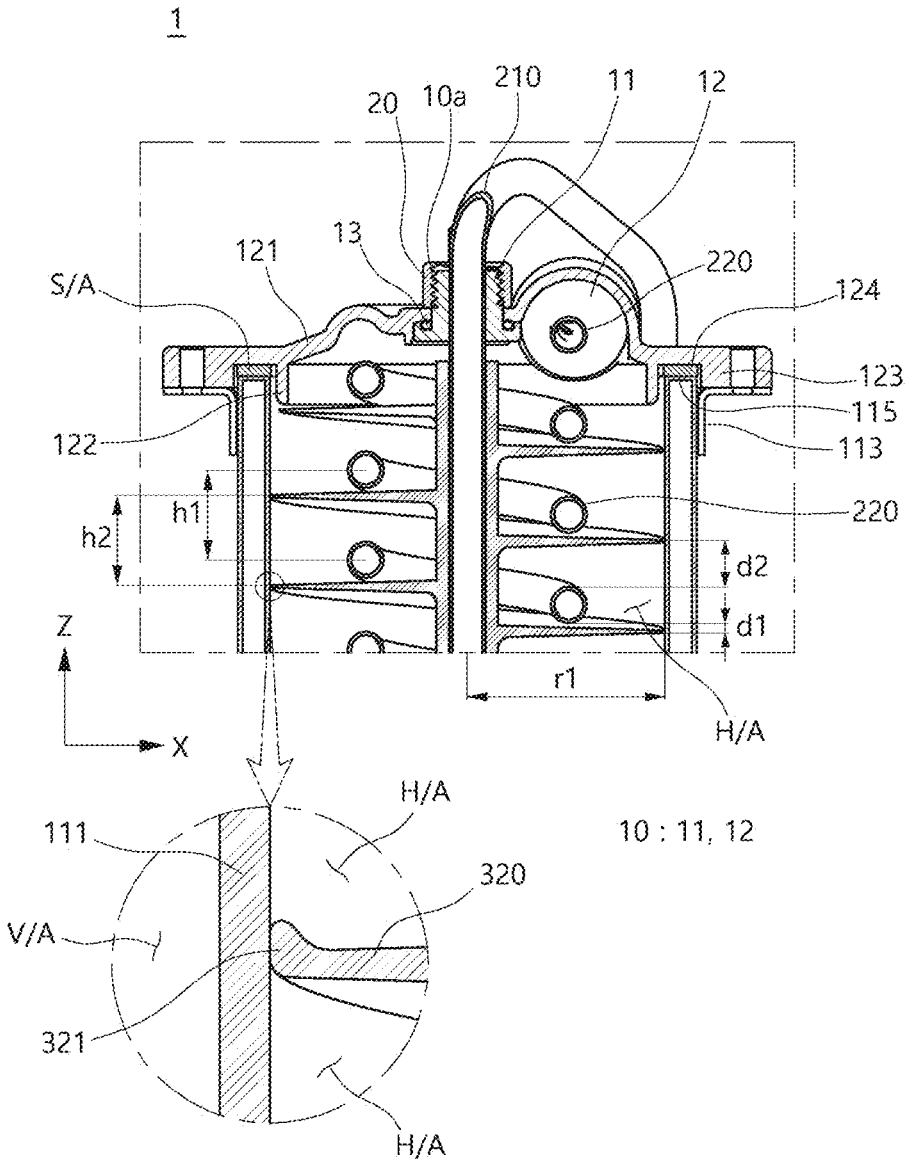
FIG. 4 is a view showing arrangement of an evaporator and a partition wall part and a structure of a cap part at an angle different from that of FIG. 3 through a cross section taken along line III-III' in the cold water tank assembly according to an exemplary embodiment of the present invention.
Figure 5:
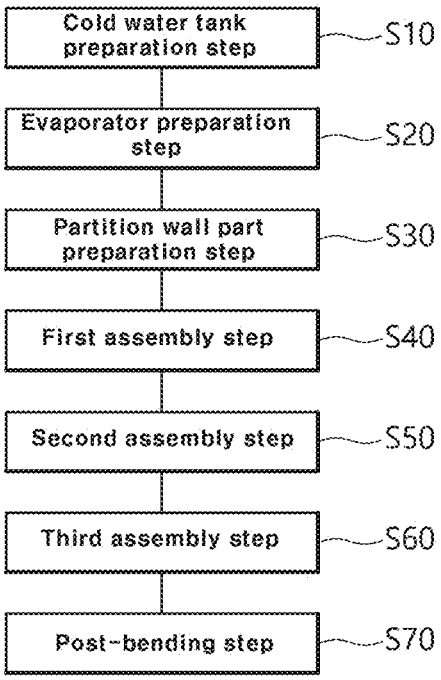
FIG. 5 is a block diagram showing a method for manufacturing a cold water tank assembly according to an exemplary embodiment of the present invention.

Meanwhile, as shown in FIGS. 2 to 4, the body part 110 of the cold water tank 100 has a dual structure of an inner cylinder 111 and an outer cylinder 112.

The inner cylinder 111 forms an accommodation space S so that the spiral evaporator 200 and the spiral partition wall part 300 may be accommodated and arranged therein, and the outer cylinder 112 has a structure that surrounds the inner cylinder 111 while being disposed at a distance from the outer circumferential surface of the inner cylinder 111 to form a space V/A.

In this case, the space V/A formed by the inner cylinder 111 and the outer cylinder 112 preferably forms a vacuum insulation space.

In other words, the vacuum insulation space V/A formed by the inner cylinder 111 and the outer cylinder 112 blocks heat transfer by forming an insulation space by making the wall surface of the body part 110 a vacuum lower than atmospheric pressure, and prevents the generated low-temperature cold water from increasing the temperature through heat exchange with the outside.

Meanwhile, of course, the space V/A formed by the inner cylinder 111 and the outer cylinder 112 does not necessarily have to be a vacuum insulation space, and the above space V/A may be filled with insulation materials, etc. as necessary.

Although heat transfer may be blocked through treatment such as insulation, in the embodiment of the present invention, it will be described that the space V/A formed by the inner cylinder 111 and the outer cylinder 112 is formed as a vacuum insulation space to increase the heat transfer blocking effect.

Meanwhile, the body part 110 of the cold water tank 100 is made of stainless steel with strong corrosion resistance, but is not limited, and of course, may be made of various materials such as metal or plastic that are strong in corrosion resistance and have rigidity.

In addition, the open entrance in the upper portion in the third direction of the body part 110 is sealed by the cap part 120.

The cap part 120 is coupled to the first assembly through a second assembly step S50 described later, an assembly assembled through this (hereinafter referred to as a 'second assembly') is coupled to the body part 110 and the cap part 120 has a structure that seals the entrance of the body part 110.

Meanwhile, an inlet pipe 130 may be formed in the cap part 120 to communicate with the accommodation space S of the body part 110, and may include a temperature sensor 160 and an air vent pipe 150.

As described above, the cap part 120 has a structure capable of sealing the accommodation space S of the body part 110 while insulating the accommodation space S.

Figure 10:
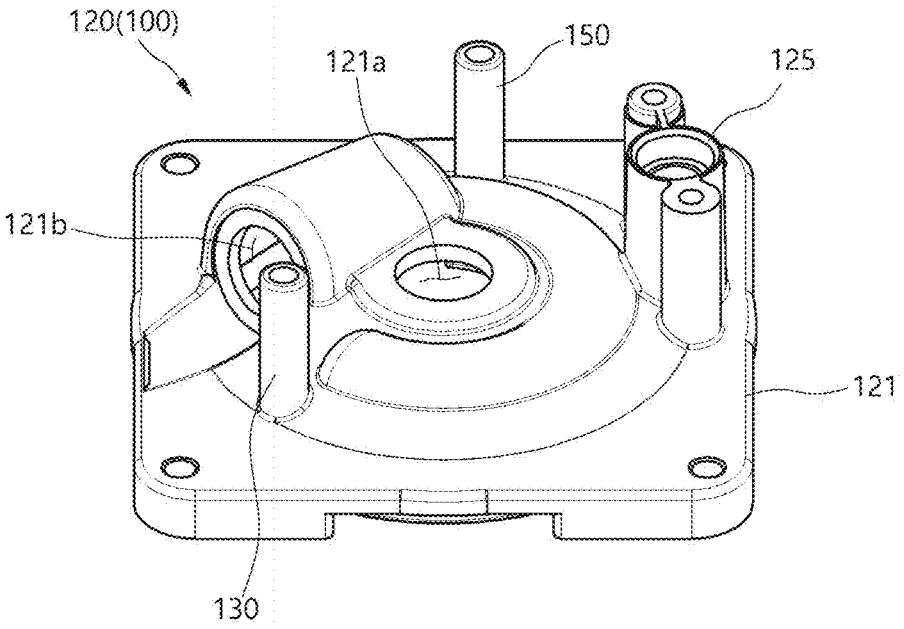
FIG. 10 is a view showing an example of a cap part applied to a cold water tank assembly according to an exemplary embodiment of the present invention.

In an embodiment for this, referring to FIG. 10 together with FIGS. 2 to 4, the cap part 120 includes a plate body 121 having a size enough to cover the entrance of the body part 110, a first wall 122 protruding downward in the third direction so that a part of the plate body 121 is in contact with the upper inner circumferential surface of the body part 110, that is, the inner circumferential surface of the inner cylinder 111, and a second wall 123 protruding downward in the third direction so that another part of the plate body 121 is in contact with the upper outer circumferential surface of the body part 110, that is, the outer circumferential surface of the outer cylinder 112.

The cap part 120 is supported on and fixed to the body part 110 through a fixing bracket 113.

Meanwhile, the body part 110 and the cap part 120 include a sealing structure to insulate the accommodation space S while sealing the accommodation space S.

In other words, when the cap part 120 is coupled to seal the entrance 114 of the body part 110 of the cold water tank 100 in the third direction, the first wall 122 of the cap part 120, an upper end edge 115 (FIG. 4) of the body part 110, and the second wall 123 of the cap part 120 form a sealing space S/A therebetween, and a rubber or silicone packing member 124 is provided in the sealing space S/A.

The cap part 120 is coupled by pressing downward from the top to the bottom in the third direction of the body part 110 while completely sealing the entrance 114 of the body part 110, and the accommodation space S of the body part 110 may be formed in a vacuum state through the packing member 124 that blocks the sealing space S/A.

Meanwhile, while forming the accommodation space S of the body part 110 in a vacuum state, pressure is inevitably generated upward in the third direction of the cap part 120.

In order to maintain the shape of the cap part 120 while offsetting this pressure, preferably, the plate body 121 of the cap part 120 forms a convex round surface upward in the third direction.

As described above, the cold water tank 100 constituting the cold water tank assembly 1 according to an exemplary embodiment of the present invention is composed of a combination of the body part 110 and the cap part 120.

And, for example, as shown in FIGS. 1 to 3, an inlet pipe 130 is formed in the cap part 120 to communicate with the accommodation space S of the body part 110, and an outlet pipe 140 is formed in the lower part in the third direction of the body part 110 to communicate with the accommodation space S.

In other words, the cap part 120 includes, at one side, an inlet pipe 130 through which purified water at room temperature is introduced and that communicates with the first heat exchange chamber H/Al (FIG. 2) to be described later in the accommodation space S. In addition, the body part 110 has a structure including an outlet pipe 140 that communicates with the last of the accommodation space S, that is, the $N^{th}$ heat exchange chamber H/An and extracts low-temperature purified water.

The inlet pipe 130 is a flow path that introduces purified water at room temperature into the accommodation space S, and the inlet pipe 130 has a position where the end passing through the cap part 120 communicates with the first heat exchange chamber H/Al located at the top in the third direction so that the purified water at room temperature can sequentially pass through the N heat exchange chambers H/A to be described later.

Although the inlet pipe 130 is illustrated in a structure of penetrating only the plate body 121 in the cap part 120 in the drawings, the present invention is not limited thereto, and of course, it may have a set length and an end extending into the first heat exchange chamber H/A1.

The outlet pipe 140 is a flow path through which low-temperature purified water cooled while sequentially passing through the N heat exchange chambers H/A formed in the accommodation space S is discharged to the outside, and the outlet pipe 140 is disposed on the bottom surface in the third direction of the body part 110 of the cold water tank 100 to discharge the purified water cooled to the lowest temperature to the outside. In this case, the outlet pipe 140 has a position where the end communicates with the last heat exchange chamber H/An, that is, the $N^{th}$ heat exchange chamber H/An, which is located at the bottom of the accommodation space S.

Accordingly, in the cold water tank assembly 1 according to an exemplary embodiment of the present invention, purified water at room temperature is introduced into the accommodation space S through the inlet pipe 130, cooled to a set temperature by the evaporator 200 described later while passing through the N heat exchange chambers H/A, and then discharged to the outside through the outlet pipe 140.

And, as described above, the cold water tank assembly 1 according to an exemplary embodiment of the present invention is configured to maximize the amount of cold water extraction while miniaturizing the size compared to the conventional cold water tank capacity.

To this end, a spiral evaporator 200 and a spiral partition wall part 300 are disposed in the internal accommodation space S of the cold water tank 100.

Referring back to FIGS. 1 to 4, the spiral evaporator 200 largely includes a spiral shaft tube 210 and a spiral tube 220.

The spiral shaft tube 210 is disposed in the third direction on the accommodation space S of the body part 110, which is introduced into the accommodation space S while passing through the cap part 120 and extends in the third direction in a straight line, and the end preferably extends near the bottom surface of the body part 110.

In addition, the spiral tube 220 is formed by extending one end of the spiral shaft tube 210, that is, specifically an end extending near the bottom surface of the body part 110, again in the third direction while the one end forms N (N is an integer of 1 or more) turns of the first spirals at a set pitch h1 (FIG. 4) with the spiral shaft tube 210 as the central axis. In addition, the extended end of the spiral tube 220 passes through the cap part 120 and escapes to the outside of the body part 110 again.

In the end, the spiral evaporator 200 has an extended single tube with the same diameter that forms a spiral shaft tube 210 and a spiral tube 220, and has a shape in which the spiral shaft tube 210 passes through the cap part 120, is introduced into the accommodation space S, and the end thereof forms the first spiral with the spiral tube 220 and passes through the cap part 120 to exit to the outside.

In addition, refrigerant is introduced into the spiral shaft tube 210 and the spiral tube 220 that make up the spiral evaporator 200, and the evaporator 200 cools purified water at room temperature flowing into the accommodation space S of the body part 110 into purified water at low temperature with a set temperature.

Meanwhile, an end in the second direction of the spiral tube 220 is arranged with a gap with the inner circumferential surface of the inner cylinder 111 of the body part 110, so that the spiral tube 220 is located in the space of the heat exchange chamber H/A to be described later.

Meanwhile, preferably, the spiral shaft tube 210 of the evaporator 200 applied to the cold water tank assembly 1 of the present invention has an axial extension line 210*a* (FIG. 8) capable of protruding and extending outward through the cap part 120 upward in the third direction, and the spiral tube 220 has an extension line 220*a* (FIG. 8) extending without being bent so that an end thereof has directionality in the first direction or the second direction to pass through the cap part 120 described above to protrude and extend to the outside.

The spiral shaft tube 210 and the spiral tube 220 of the evaporator 200 are coated while removing fine scratches or contamination on the outer circumferential surface through an electrolytic polishing process S22 in an evaporator preparation step S20 to be described later.

Additionally, they are combined through a first assembly step S40 with the partition wall part 300, which will be described later, and as the axial extension line 210*a* has a straight line in the third direction without bending, and the extension line 220*a* has a straight line in the first direction or the second direction, they may be smoothly combined with the partition wall part 300 through a rotational assembly process S42.

In other words, the evaporator 200 applied to the present invention includes a spiral shaft tube 210 having a set length, and a spiral tube 220 that forms N turns of the first spirals along the length with a predetermined pitch around the spiral shaft tube 210 by bending one side of the spiral shaft tube 210, and has an extension line 220*a* extending without bending at the end to have directionality in the first direction or second direction.

Meanwhile, the axial extension line 210*a* of the spiral shaft tube 210 and the extension line 220*a* of the spiral tube 220 penetrate the cap part 120 constituting the cold water tank 100 as described above, extend outside the body part 110 of the cold water tank 100, and have a post-bending process outside the cold water tank 100 as needed through a post-assembly step S70.

In this case, the extension line 220*a* is preferably formed longer than the radius r1 (FIG. 4) of the second spiral formed by the partition 320 of the partition wall part 300 to be described later, so that it may be extended and exposed to the outside of the cold water tank 100.

In this case, the axial extension line 210*a* of the spiral shaft tube 210 and the extension line 220*a* of the spiral tube 220 have a structure that is hermetically coupled to the cap part 120 through a flange 10.

To this end, referring to FIGS. 2 to 4 and 10, the cap part 120 includes a first hole 121*a* (FIG. 10) into which a first flange 11 (FIG. 4) fused to the spiral shaft tube 210 is closely fitted, and a second hole 121*b* (FIG. 10) into which a second flange 12 (FIG. 2) fused to the spiral tube 220 is closely fitted.

In this case, the first hole 121*a* has the same directionality as the axial extension line 210*a* of the spiral shaft tube 210 upward in the third direction, and the second hole 121*b* has the same directionality as the extension line 220*a* of the spiral tube 220 in the first direction or second direction.

Meanwhile, the flange 10, that is, the first flange 11, the second flange 12, includes a sealing member 13 along one side that is in contact with the cap part 120 to increase sealing properties. In this case, preferably, of course, the sealing member 13 may have an O-ring shape or a planar shape as needed.

In addition, the above-described flange 10 increases binding and hermeticity by combining a fastening screw 20 with a thread 10*a* (FIG. 4) formed on the outer circumferential surfaces of the first flange 11 exposed to the outside of the first hole 121*a* and the second flange 12 exposed to the outside of the second hole 121*b*, respectively, through a second assembly step S50.

Next, referring back to the drawing, the spiral partition wall part 300 applied to the cold water tank assembly 1 according to an exemplary embodiment of the present invention partitions the accommodation space S of the body part 110 into a plurality of heat exchange chambers H/A.

To this end, the spiral partition wall part 300 includes a shaft body 310 and a partition 320.

The shaft body 310 of the partition wall part 300 has a tubular shape having a set length to surround the spiral shaft tube 210 of the evaporator 200 described above.

In this case, if the shaft body 310 has a shape surrounding the spiral shaft tube 210, it may have a cross section of various shapes such as a circular shape and an elliptical shape.

Furthermore, the partition 320 of the partition wall part 300 has a plate shape that expands in the first direction and second direction around the shaft body 310, and has a structure that extends in the third direction while forming N turns of the second spirals at a set pitch h2 (FIG. 4).

In other words, the partition wall part 300 has a structure in which a plurality of plate-shaped partitions 320 form N turns of the second spirals around the shaft body 310 and extend in the third direction.

In this case, preferably, the partition 320 that constitutes the spiral partition wall part 300 is arranged such that the inner circumferential surface of the accommodation space S of the cold water tank 100, that is, the inner circumferential surface of the inner cylinder 111 and an end edge 321 are in closely contact with each other (see FIG. 4).

In addition, the pitch h2 of the partition 320 forming the N turns of the second spirals is preferably formed equal to the pitch h1 of the spiral tube 220 of the evaporator 200 forming the N turns of the first spirals.

Furthermore, as the end in the second direction of the spiral tube 220 is arranged to have a gap with the inner circumferential surface of the inner cylinder 111 of the body part 110, the radius of the first spiral of the spiral tube 220 is formed smaller than the radius of the second spiral of the partition 320.

Accordingly, the partition 320 forms N heat exchange chambers H/A to have a spiral structure as a flow path communicating with the inlet pipe 130 and the outlet pipe 140 in the third direction in the accommodation space S of the cold water tank 100, and the spiral tube 220 of the spiral evaporator 200 is disposed while continuously passing through each of these N heat exchange chambers H/A (see FIG. 3).

Meanwhile, part or all of the partition 320 of the above-described partition wall part 300 is formed of a soft material, and the end edge 321 of the partition 320 is disposed to press the inner circumferential surface of the accommodation space S of the cold water tank 100 (see FIG. 4).

Accordingly, the purified water introduced into the heat exchange chamber H/A is completely blocked from exiting downward through the edge gap of the partition 320, and the N heat exchange chambers H/A form a continuous spiral flow path. In addition, the purified water introduced through the inlet pipe 130 flows while cooling to a set temperature while necessarily exchanging heat with the spiral tube 220 of the heat exchange chamber H/A.

As such, the cold water tank assembly 1 according to an exemplary embodiment of the present invention may maximize heat exchange efficiency and cool the purified water at room temperature into purified water at a low temperature having a set temperature in a short time.

As described above, the cold water tank assembly 1 according to an exemplary embodiment of the present invention includes a spiral evaporator 200 and a spiral partition wall part 300 in the accommodation space S of the cold water tank 100, and by the spiral tube 220 of the evaporator 200 forming the first spiral and the partition 320 of the partition wall part 300 forming the second spiral, N heat exchange chambers H/A with flow paths in the third direction are formed in the accommodation space S described above with a spiral structure.

In addition, as the spiral tube 220 of the evaporator 200 is arranged in a spiral shape in each heat exchange chamber H/A, purified water at room temperature introduced through the inlet pipe 130 is heat exchanged with the evaporator 200 while continuously passing through the N heat exchange chambers WA in a spiral shape.

Accordingly, the cold water tank assembly 1 according to an exemplary embodiment of the present invention discharges fast-cooled low-temperature purified water through the outlet pipe 140 while reducing cooling time compared to the conventional cold water tank of the same size.

In addition, ice is formed on the outer circumferential surface of the evaporator 200 provided in the accommodation space S in the cold water tank 100. The introduced purified water at room temperature becomes a low-temperature purified water by the evaporator 200 as it passes through the heat exchange chamber H/A, and the ice formed on the outer circumferential surface of the evaporator 200 melts and is extracted externally with the low-temperature purified water, increasing the amount of cold water extracted compared to the amount of purified water at room temperature supplied. Through this, it can be seen that the cold water efficiency increases soon.

Meanwhile, referring back to FIGS. 2 to 4, the cold water tank 100 includes a temperature sensor 160 that measures the temperature within the accommodation space S.

As described above, the inlet pipe 130, and the spiral shaft tube 210 and the spiral tube 220 of the evaporator 200 are arranged in the cap part 120 constituting the cold water tank 100 to communicate with the outside.

In addition, a temperature sensor 160 is further included on one side of the cap part 120, and the temperature sensor 160 has a set length and is arranged to extend through one side of the plate body 121 of the cap part 120 to one side of the accommodation space S of the cold water tank 100.

The temperature sensor 160 may be supported and disposed by a sensor holder 125 (FIGS. 1 and 10) provided on one side of the cap part 120.

Preferably, the temperature sensor 160 is disposed close to the spiral tube 220 of the evaporator 200, and makes it possible to quickly measure the temperature change in the accommodation space S.

For example, the temperature sensor 160 has a set length and may be placed while passing through a set number of heat exchange chambers H/A from the top of the body part 110 to downward in the third direction.

In this case, the partition 320 of the partition wall part 300 forms a through hole 322 (FIG. 9) through which the temperature sensor 160 passes, and preferably the through hole 322 is formed smaller than the diameter of the temperature sensor 160, and the partition 320 is made of a soft material, so it is close to the temperature sensor 160 so that purified water does not leak into the fine gap.

Meanwhile, if the distance between the temperature sensor 160 and the evaporator 200 is too close, accurate temperature control may not be easy because a sudden temperature change near the evaporator 200 is measured by the temperature sensor 160.

Accordingly, the temperature sensor 160 is arranged to have a certain distance from the evaporator 200 in the heat exchange chamber H/A so that the temperature change in the accommodation space S, that is, the heat exchange chamber H/A by the evaporator 200 can be accurately measured and the temperature control according to the temperature change can be performed easily.

To this end, in the cold water tank assembly 1 according to an exemplary embodiment of the present invention, the spiral tube 220 constituting the evaporator 200 is arranged to pass through the central portion of the heat exchange chamber H/A, and preferably, the spiral tube 220 is arranged such that the first distance d1 from the partition 320 disposed at the lower portion of the heat exchange chamber H/A is equal to or smaller than the second distance d2 from the partition 320 disposed at the upper portion (see FIG. 4).

When the first distance d1 is smaller than the second distance d2, the temperature sensor 160 has an end disposed at the second distance d2 described above and has a distance with ice generated by the evaporator 200, so that it may measure the temperature change more stably because it does not directly contact the ice.

Additionally, if the first distance d1 and the second distance d2 are identical, the upper and lower portions of the spiral tube 220 have a predetermined distance with the partition 320, and ice is created on this distance, and the introduced purified water will come into contact with the upper and lower portions of the ice produced in the heat exchange chamber H/A generated by the partition 320, which will speed up the formation of low-temperature purified water.

Meanwhile, the cap part 120 may include an air vent pipe 150 as described above.

The air vent pipe 150 controls the air inside the body part 110 to be discharged to the outside of the body part 110 according to the level of purified water accommodated in the body part 110 of the cold water tank 100.

For example, the air vent pipe 150 is closed so that the air inside the accommodation space S of the body part 110 is not discharged to the outside of the body part 110 to prevent the leakage of chilliness, and when the level of purified water accommodated in the body part 110 rises, the air vent pipe 150 allows the air inside the accommodation space S of the body part 110 to be discharged to the outside of the body part 110, preventing the body part 110 from being damaged by the internal pressure of the body part 110.

Meanwhile, of course, the air vent pipe 150 may be in the form of a hole.

Meanwhile, the cold water tank assembly 1 according to an exemplary embodiment of the present invention includes an outlet pipe 140 to extract low-temperature purified water cooled in the internal accommodation space S of the cold water tank 100 to the outside as described above.

For example, the outlet pipe 140 is provided on the bottom surface of the body part 110 and may be formed to communicate with the $N^{th}$ heat exchange chamber H/An formed upward in the third direction in the accommodation space S.

In this way, the cold water tank 100 can be manufactured to be more miniaturized by providing the outlet pipe 140 at the lower portion of the body part 110.

Meanwhile, as described above, the cold water tank assembly 1 according to the present invention is arranged by inserting the evaporator 200 and the partition wall part 300 into the accommodation space S of the body part 110 of the cold water tank 100.

In addition, as the temperature inside the accommodation space S is lowered by the evaporator 200, ice is first formed on the lower side of the evaporator 200, and the generated ice gradually expands outward from the evaporator 200, starting with the outer circumferential surface of the evaporator 200.

Accordingly, the ice generated in the evaporator 200 in the last heat exchange chamber located at the bottom of the accommodation space S of the body part 110, that is, the $N^{th}$ heat exchange chamber H/An, may be expanded downward to be formed in contact with the bottom surface of the body part 110.

As a result, the outlet 141 (FIG. 3) of the outlet pipe 140 disposed in the $N^{th}$ heat exchange chamber H/An may be blocked by ice generated in the evaporator 200 or the flow of purified water (cold water) may be hindered.

Although the length of an end of the evaporator 200 is set to have a set distance from the bottom surface, the cold water tank assembly 1 is in the trend of miniaturization, and it may be difficult to arrange the positions of the bottom surface of the body part 110 and the end of the evaporator 200 to have the best distance due to the manufacturing tolerance of the evaporator 200, the partition wall part 300, and the cap part 120.

In addition, the position of the end in the third direction of the evaporator 200 may be changed due to force being applied while assembling the cap part 120 of the cold water tank 100 to the evaporator 200 according to a third assembly step S60, which will be described later.

Therefore, the cold water tank assembly 1 according to an exemplary embodiment of the present invention further includes a separation spacer 400 so that the end in the third direction of the evaporator 200 and the bottom surface of the accommodation space S are arranged to have an accurate distance.

Figure 11:
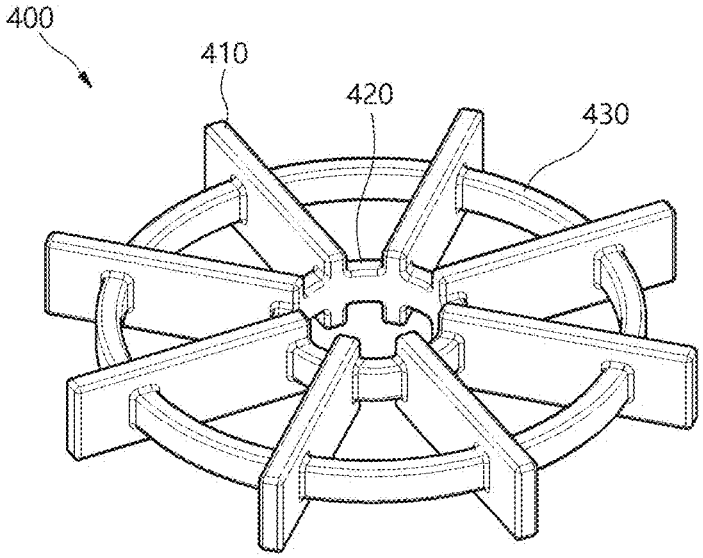
FIG. 11 is a view showing an example of a separation spacer applied to a cold water tank assembly according to an exemplary embodiment of the present invention.

For example, referring to FIGS. 2, 3, and 11, the separation spacer 400 has a plurality of support ribs 410 and is arranged to be spaced apart from the lower bottom surface of the accommodation space S. In addition, the end of the evaporator 200 passing through the $N^{th}$ heat exchange chamber H/An and the upper side of the separation spacer 400 are arranged to be in contact with each other (see FIGS. 2 and 3).

In other words, the operator inserts the assembly of the evaporator 200 and the partition wall part 300 into the body part 110 until the end of the evaporator 200 comes into contact with the separation spacer 400, and so that the end of the evaporator 200 always has a set distance from the bottom surface.

The separation spacer 400 may have a rectangular or polygonal pallet shape having a plurality of support ribs 410, or may have a circular or elliptical pedestal shape.

For example, as shown in FIG. 11, the separation spacer 400 may have a structure including a ring-shaped first support 420, a ring-shaped second support 430 surrounding the first support 420, and a plurality of support ribs 410 radially arranged connecting the first support 420 and the second support 430 in a plate shape.

However, the shape of the separation spacer 400 is not determined, and of course, various shapes and structures can be applied if the distance between the end of the evaporator 200 and the bottom surface can be maintained.

Meanwhile, as the ice generated in the evaporator 200 expands first along the outer circumferential surface of the separation spacer 400 in contact with the end of the evaporator 200, it prevents the outlet 141 of the outlet pipe 140 arranged in the $N^{th}$ heat exchange chamber H/An from being blocked by the ice generated in the evaporator 200 in advance and facilitates the flow of purified water (cold water).

Accordingly, it is possible to minimize the design space of the water purifier by maximizing the cold water efficiency (the value obtained by dividing the cold water extraction amount by the tank capacity) compared to the cold water tank capacity while miniaturizing the cold water tank 100.

Meanwhile, as described above, the cold water tank assembly 1 according to an exemplary embodiment of the present invention combines the evaporator 200 placed inside the cold water tank 100 in contact with purified water (water) as it was initially manufactured, and after it is combined, there is no post-bending process inside the cold water tank 100, so it is possible to prevent cracks and rust occurrence due to post-bending.

Referring back to FIGS. 1 to 11, the above-described method for manufacturing a cold water tank assembly is a method of manufacturing a cold water tank assembly 1 in which purified water at room temperature passes through N heat exchange chambers H/A having a spiral orbit and is extracted as purified water at low temperatures, and largely includes a cold water tank preparation step S10, an evaporator preparation step S20, a partition wall part preparation step S30, a first assembly step S40, a second assembly step S50, and a third assembly step S60.

First, the cold water tank preparation step S10 is a step of producing and preparing components constituting the cold water tank 100 including a body part 110 and a cap part 120.

In other words, it includes a process of preparing a cylindrical body part 110 with an open entrance and an accommodation space S inside, and a process of preparing a cap part 120 that seals the open entrance of the body part 110.

The body part 110 and the cap part 120 may be manufactured through various molding methods, and may be made of various materials such as stainless steel materials or plastics with high insulation and strong corrosion resistance.

Figure 6:
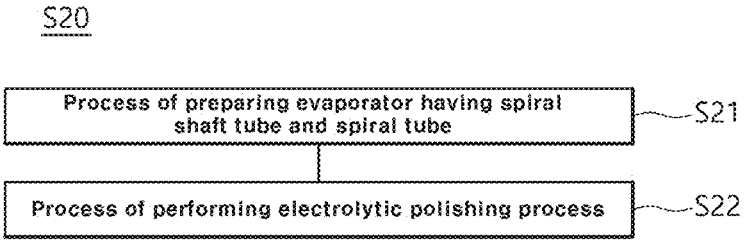
FIG. 6 is a block diagram showing a step of preparing an evaporator in FIG. 5.

In addition, the evaporator preparation step S20 includes a process S21 of preparing an evaporator having a spiral shaft tube and a spiral tube and a process S22 of performing an electrolytic polishing (see FIG. 6).

In this case, as described in detail through the structure of the cold water tank assembly 1, the process S21 of preparing an evaporator prepares an evaporator 200 including a spiral shaft tube 210 having a set length and a spiral tube 220 that forms N turns of the first spirals along the length at a set pitch around the spiral shaft tube 210 by bending one side of the spiral shaft tube 210, and has an extension line 220*a* extending without bending at the end to have directionality in the first direction or second direction.

The evaporator 200 is made of a metal material such as copper or stainless steel, and a structure of the spiral shaft tube 210 and the spiral tube 220 having a first spiral is prepared by including a bending process.

In addition, the evaporator 200 is coated while removing fine scratches or contamination on the outer circumferential surface through the process S22 of performing an electrolytic polishing.

Meanwhile, the partition wall part preparation step S30 includes a process of preparing a tubular shaft body 310 with a set length and a partition wall part 300 that has a plate shape extending in the first direction and the second direction around the shaft body 310 and forms a partition 320 extending in the third direction while forming N turns of the second spirals at a set pitch.

In this case, the partition wall part 300 may be manufactured through various molding methods, may be manufactured using silicone or rubber, and may be partially or entirely made of a soft material as needed.

Subsequently, the evaporator 200 and the partition wall part 300 prepared as described above are assembled in the form of a first assembly through the first assembly step S40 to combine with the cold water tank 100.

Figure 7:
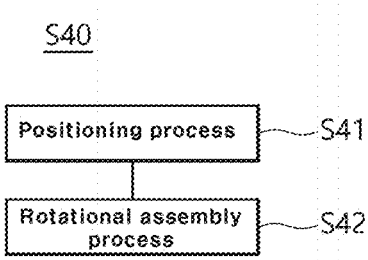
FIG. 7 is a block diagram showing a first assembly step in FIG. 5.

To this end, the first assembly step S40 includes a positioning process S41 and a rotational assembly process S42, as shown in FIG. 7.

Figure 8:
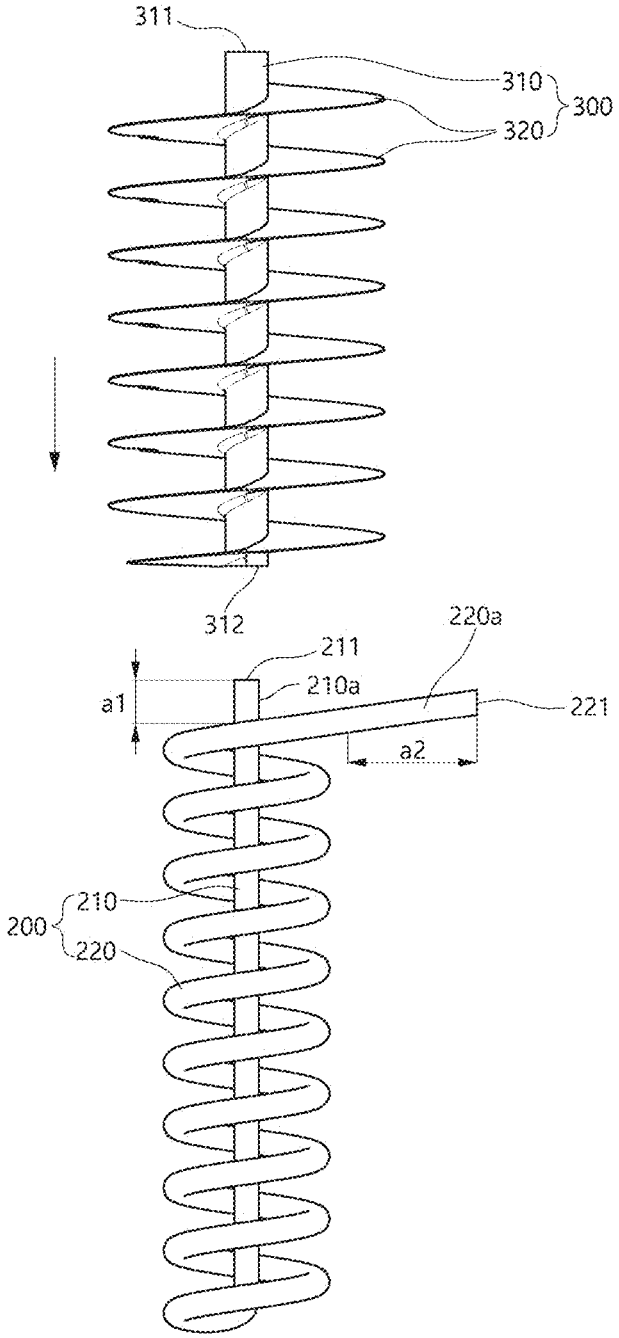
FIG. 8 is a schematic view showing a first assembly step in FIG. 5.
Figure 9:
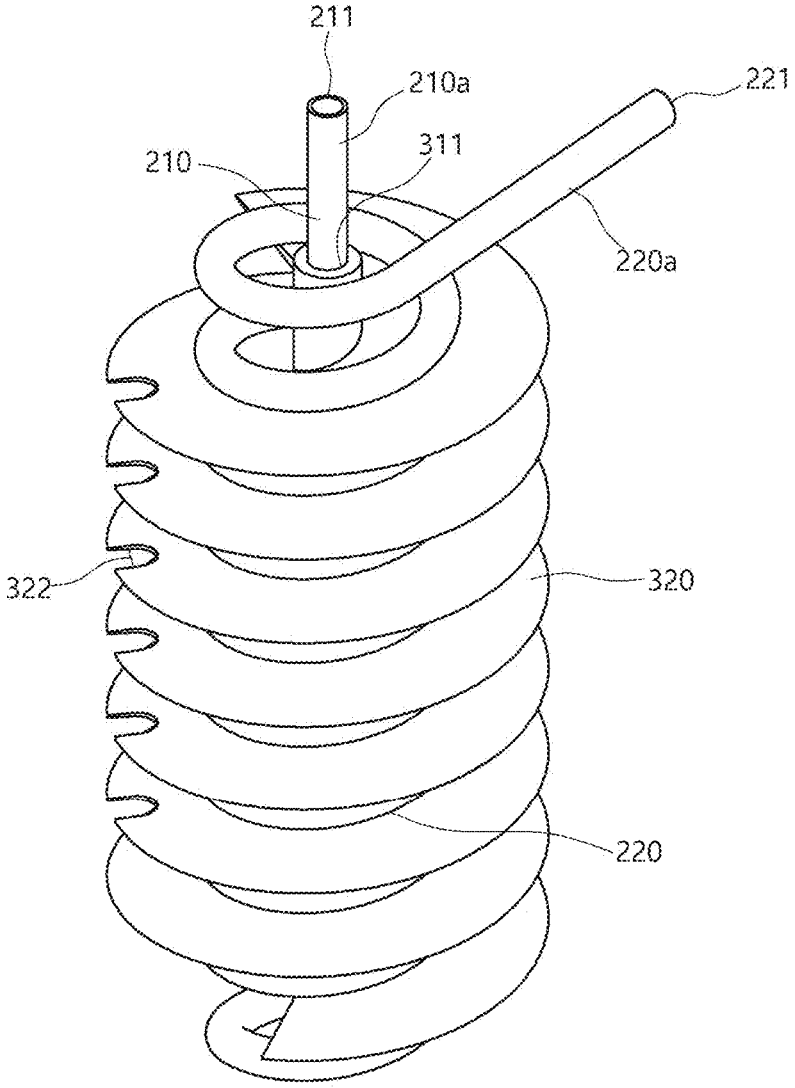
FIG. 9 is a view showing a first assembly coupled through a first assembly step in FIG. 5.

Referring to FIGS. 8 and 9, first, the positioning process S41 is a process of positioning the lower hole 312 of the shaft body 310 constituting the partition wall part 300 on the upper end 211 of the spiral shaft tube 210 constituting the evaporator 200.

In this case, the spiral shaft tube 210 includes the shaft extension line 210*a* and has a shape that may be included in the inner hollow of the shaft body 310.

In addition, the rotational assembly process S42 is a process of rotating the evaporator 200 or partition wall part 300 in one direction so that the spiral shaft tube 210 passes through the shaft body 310 and the spiral tube 220 passes between the partition 320 and the partition 320.

This rotational assembly process S42 may be performed automatically or manually, of course, and through this rotational assembly process S42, the evaporator 200 and the partition wall part 300 have a form of the first assembly as shown in FIG. 9.

In this case, since the extension line 220*a* has directionality in the first direction or the second direction with the same as the direction in which the partition 320 forms a spiral, and has a straight line shape without bending, the extension line 220*a* may be coupled to the partition wall part 300 while rotating along the shape of the second spiral without being caught or blocked by the partition 320 in the rotational assembly process S42.

In other words, the extension line 220*a* of the spiral tube 220 is assembled while sequentially passing between the partition 320 and the partition 320 forming the second spiral.

In this case, the spiral tube 220 is assembled so that the first distance d1 (FIG. 4) from the partition 320 placed at the lower portion of the heat exchange chamber H/A is equal to or smaller than the second distance d2 (FIG. 4) from the partition 320 placed at the upper portion, as described in the above cold water tank assembly 1 structure.

Subsequently, the second assembly step S50 is a step of assembling the first assembly to have the shape of a second assembly by coupling the cap part 120 (see FIG. 10) to the first assembly.

To this end, the second assembly step S50 includes a flange fastening process in which the flange 10 is thermally fused to one side of the spiral shaft tube 210 and one side of the spiral tube 220, and a cap part assembly process in which the cap part is assembled to the first assembly so that the spiral shaft tube 210 and the spiral tube 220 pass through the cap part 120 and then are exposed to the outside.

The cap part 120 includes a first hole 121*a* (FIG. 10) into which a first flange 11 (FIG. 4) fused to the spiral shaft tube 210 is closely fitted, and a second hole 121*b* (FIG. 10) into which a second flange 12 (FIG. 2) fused to the spiral tube 220 is closely fitted.

In this case, the first hole 121*a* has the same directionality as the axial extension line 210*a* of the spiral shaft tube 210 upward in the third direction, and the second hole 121*b* has the same directionality as the extension line 220*a* of the spiral tube 220 in the first direction or second direction.

With the first flange 11 and the second flange 12 thermally fused through the flange fastening process, the cap part assembly process is performed in which the cap part is assembled to the first assembly so that the spiral shaft tube 210 and the spiral tube 220 pass through the cap part 120 and then are exposed to the outside, and in this process, the first flange 11 is fitted into the first hole 121*a* to be sealed, and the second flange 12 is fitted into the second hole 121*b* to be sealed.

Then, the second assembly step S50 further includes a screw fastening process of combining a fastening screw 20 with a thread 10*a* formed on the outer circumferential surfaces of the first flange 11 exposed to the outside of the first hole 121*a* and the second flange 12 exposed to the outside of the second hole 121*b*, respectively, and using this step, constitutes a second assembly.

Subsequently, the third assembly step S60 includes an insertion process of inserting and arranging the second assembly into the accommodation space S of the body part 110 to form N heat exchange chambers H/A in the accommodation space S of the body part 110, and using this step, completely assembles the cold water tank assembly 1.

In this case, the partition 320 of the partition wall part 300 is arranged so that the end edge 321 presses the inner surface of the accommodation space of the body part 110 (see FIG. 4).

Subsequently, the method for manufacturing a cold water tank assembly according to an exemplary embodiment of the present invention further includes a post-assembly step S70 to facilitate connection with other external connection flow paths constituting the water purifier while stably arranging the cold water tank assembly 1 that has gone through the third assembly step S60 on the inner accommodation space S.

The post-assembly step S70 includes a sensor mounting process of mounting the temperature sensor 160 on the cap part 120 of the cold water tank assembly 1, and a post-bending process of bending one side of the axial extension line 210*a* of the spiral shaft tube 210 and one side of the extension line 220*a* of the spiral tube 220 that pass through the cap part 120 and are placed outside the cold water tank 100 as shown in "a" of FIG. 2.

In this way, since the axial extension line 210*a* of the spiral shaft tube 210 and the extension line 220*a* of the spiral tube 220 that are post-bended are parts disposed outside the cold water tank 100 and do not come into contact with purified water (water) during the process of extracting the purified water (cold water) at low temperatures, even if post-bending is performed, foreign substance intrusion into the cold water tank 100 due to crack generation may be completely blocked.

As described above, the cold water tank assembly 1 manufactured in accordance with the method for manufacturing a cold water tank assembly according to the present invention combines the evaporator 200 placed inside the cold water tank 100 in contact with purified water (water) as it was initially manufactured, and after it is combined, there is no post-bending process on the accommodation space S inside the cold water tank 100, so it is possible to prevent cracks and rust occurrence due to post-bending.

In addition, as it partitions the accommodation space S inside the cold water tank 100 into a plurality of (N) heat exchange chambers H/A that continuously communicate with each other using the spiral evaporator 200 and the spiral partition wall part 300, the introduced purified water sequentially passes through the N heat exchange chambers (H/A), heat-exchanging, thereby capable of maximizing heat exchange efficiency and cooling the purified water at room temperature to low-temperature purified water (cold water) with a set temperature in a short time.

In addition, as the cylindrical accommodation space is formed to make a plurality of (N) heat exchange chambers to have a spiral shape through the spiral evaporator 200 and the spiral partition wall part 300, the size of the cold water tank 100 can be miniaturized and the amount of cold water extracted can be maximized.

Furthermore, the N heat exchange chambers H/A formed by the spiral evaporator 200 and the spiral partition wall part 300 on the accommodation space S of the cold water tank 100 each have a spiral orbit and form a continuous flow path, inducing purified water introduced into the accommodation space through the inlet pipe 130 to have a natural flow without colliding or clogging, thereby increasing the rate of cold water generation while being constant.

In addition, with a structure that forms a plurality of (N) spiral heat exchange chambers H/A through the spiral evaporator 200 and the spiral partition wall part 300 in the accommodation space S of the cold water tank 100, it is possible to minimize the design space of the water purifier by maximizing the cold water efficiency (the value obtained by dividing the cold water extraction amount by the tank capacity) compared to the cold water tank capacity while miniaturizing the overall cold water tank 100.

Table 1 and Table 2 are tables comparing the cold water efficiency of the conventional cold water tank assembly and the cold water tank assembly 1 according to an exemplary embodiment of the present invention.

The conventional is a cold water tank assembly with an evaporator in a quadrangular tank structure for comparison; the cooling time is the time during which the low-temperature purified water below 10° C. is extracted; the minimum cold water temperature is the minimum temperature of the low-temperature purified water extracted; the number of cups of cold water-extracted represents the number of cups from which low-temperature purified water below 10° C. is extracted based on the amount of cold water extracted once per cup of 129 ml. And the cold water efficiency is the value obtained by dividing the cold water extraction amount by the tank capacity (tank water volume).

TABLE 1

[Amount of cold water extracted once: 129 ml]

| Classification | Tank water volume | Cooling time | Minimum cold water temperature | Number of cups of cold water-extracted/ Cold water efficiency |
|---|---|---|---|---|
| Conventional (Existing) | 1 L | 58 minutes | 4.4 (6.6/4.5/4.4/ 5.5/7.6/10.2) | 5 cups/64.5% |
| Present invention 1 | 0.545 L (45.5%↓) | 38 minutes (35%↓) | 1.6 (4.4/1.6/2/5.3/ 9.7/16.2) | 5 cups/118% |
| Present invention 2 | | 43 minutes (26%↓) | 1.5 (4/2.1/1.5/3.9/ 6.6/9.8/14.8) | 6 cups/142% |

TABLE 2

[Amount of cold water extracted once: 129 ml]

| Number of cups extracted | Existing (58 minutes) | Change (38 minutes) | Change (43 minutes) |
|---|---|---|---|
| 1 | 6.6 | 4.4 | 4 |
| 2 | 4.5 | 1.6 | 2.1 |
| 3 | 4.4 | 2 | 1.5 |
| 4 | 5.5 | 5.3 | 3.9 |
| 5 | 7.6 | 9.7 | 6.6 |
| 6 | 10.2 | 16.2 | 9.8 |
| 7 | | | 14.9 |
| Tank water volume | 1000 | 545 | 545 |
| Amount of cold water extracted | 645 | 645 | 774 |
| Cold water efficiency | 64.5% | 118.3% | 142% |

Referring to Table 1 and Table 2, it can be seen that the conventional cold water tank assembly has a tank water volume of 1 L and takes 58 minutes to extract cold water (low-temperature purified water) below 10° C. by operating an evaporator, and in this case, the number of cups of cold water extracted is 5 cups. And, it can be seen that the lowest temperature of cold water is 4.4° C. Meanwhile, it can be seen that the cold water tank assembly according to the present invention can extract five cups of cold water extraction as in the conventional one when the cooling time is set to 38 minutes (the present invention 1) while reducing the tank water volume by 45.5% to 0.545 L, and in this case, the lowest temperature of the cold water is 1.6° C. In addition, it can be seen that when the cooling time of the cold water tank assembly according to the present invention is 43 minutes (the present invention 2), 6 cups of cold water extraction are extracted, one cup more than the conventional one, and the lowest temperature of the cold water is 1.5° C. Through this, it can be confirmed that the cold water efficiency of the conventional cold water tank assembly is 65.5%, the cold water efficiency of the cold water tank assembly of the present invention 1 is 118.3%, and the cold water efficiency of the cold water tank assembly of the present invention 2 is 142%.

As such, it can be seen that the cold water tank assembly 1 manufactured through the method for manufacturing a cold water tank assembly according to an exemplary embodiment of the present invention rather clearly improves the tank cold water efficiency, even though the tank capacity (tank water volume) is 45.5% less than that of the conventional cold water tank assembly.

Accordingly, the cold water tank assembly 1 according to an exemplary embodiment of the present invention can be miniaturized in size than the conventional one, thereby minimizing the design space of the water purifier.

In addition, of course, the cold water tank assembly 1 according to an exemplary embodiment of the present invention can quickly extract low-temperature purified water with a low-temperature water minimum temperature of 1.5° C., having a lower temperature than the conventional one, thereby improving user satisfaction.

Although exemplary embodiments of the present invention have been described, the idea of the present invention is not limited to the embodiments set forth herein. Those of ordinary skill in the art who understand the idea of the present invention may easily propose other embodiments through supplement, change, removal, addition, etc. of elements within the same idea, but the embodiments will be also within the idea scope of the present invention.

What is claimed is:

1. A method for manufacturing a cold water tank assembly within which purified water at room temperature passes through a plurality of heat exchange chambers having a spiral orbit, the method comprising:

preparing a cold water tank, including: preparing a cylindrical body having an opened inlet and an accommodation space therein, and preparing a cap configured to seal the opened inlet of the body;

preparing an evaporator, including: preparing the evaporator having a spiral shaft tube having a prescribed length and a spiral tube configured to form a plurality of turns of first spirals along the length with a predetermined first pitch around the spiral shaft tube by bending a side of the spiral shaft tube, wherein and the spiral tube has an extension line extending without bending at an end to have directionality in a first direction or second direction, and performing an electrolytic polishing process on the evaporator;

preparing a partition wall, including: preparing a tubular shaft body with a predetermined length and the partition wall configured to have a plate shape extending in the first direction and the second direction around the shaft body and form a partition extending in a third direction while forming a plurality of turns of second spirals at a predetermined second pitch;

assembling a first assembly, including: positioning a lower hole of the shaft body on an upper end of the spiral shaft tube, and rotating and assembling the evaporator or partition wall so that the spiral shaft tube passes through the shaft body and the spiral tube passes between the partitions;

assembling a second assembly, including: thermally fusing a flange to a side of the spiral shaft tube and a side of the spiral tube, and assembling the cap to the first assembly so that the spiral shaft tube and the spiral tube pass through the cap and then are exposed to outside; and assembling the cold water tank assembly, including: inserting and arranging the second assembly into the accommodation space of the body to form the plurality of the heat exchange chambers in the accommodation space of the body.

2. The method for claim 1, further comprising post-assembling including:

mounting a temperature sensor to the cap of the cold water tank assembly, and bending a side of the spiral shaft tube and a side of the extension line of the spiral tube that pass through the cap and are placed outside the cold water tank.

3. The method of claim 1, wherein the extension line of the spiral tube is assembled while sequentially passing through between the partitions that forms the second spiral in the rotating and assembling.

4. The method of claim 1, wherein the spiral tube is assembled so that a first distance from the partition placed at a lower portion of the heat exchange chamber is equal to or smaller than a second distance from the partition placed at an upper portion of the heat exchange chamber in the assembling the first assembly.

5. The method of claim 1, wherein the cap comprises:

a first hole into which a first flange fused to the spiral shaft tube is fitted, and a second hole into which a second flange fused to the spiral tube is fitted, and wherein the assembling the second assembly further includes:

combining a fastening screw with a thread on outer circumferential surfaces of the first flange exposed to outside of the first hole and the second flange exposed to outside of the second hole, respectively.

6. The cold water tank assembly of claim 1, wherein the cold water tank further comprises:

a spacer configured to have a plurality of support ribs and be arranged to be spaced apart from a lower bottom surface of the accommodation space so that a upper side is in contact with an end of the evaporator.

7. The cold water tank assembly of claim 6, wherein the s spacer comprises:

a ring-shaped first support;

a ring-shaped second support surrounding the first support; and the plurality of the support ribs radially arranged connecting the first support and the second support in a plate shape.

8. A cold water tank assembly, comprising:

a cold water tank including: a body configured to have a cylindrical shape with an inlet pipe and an outlet pipe through which purified water flows, said body comprising an accommodation space therein and an entrance expanded in a first direction and second direction, said entrance expanded a predetermined length in a third direction, said body comprising a cap configured to seal the entrance;

an evaporator through which refrigerant flows, the evaporator configured to include a spiral shaft tube placed in the accommodation space in the third direction, and a spiral tube in which an end of the spiral shaft tube extends in the third direction while forming a plurality of turns of first spirals at a predetermined pitch around the spiral shaft tube; and a partition wall including: a shaft body arranged to surround the spiral shaft tube, and a partition configured to have a plate shape extending in the first direction and the second direction around the shaft body and extend in the third direction while forming a plurality of turns of second spirals at a predetermined pitch, wherein an end edge of the partition is arranged closely to an inner circumferential surface of the accommodation space of the cold water tank to form a plurality of heat exchange chambers as a flow path communicating with the inlet pipe and the outlet pipe in the accommodation space in the third direction, and wherein the spiral tube is arranged to pass through the plurality of heat exchange chambers continuously, and after forming the first spiral, an extension line thereof that extends without bending for the end to have directionality in the first direction or second direction is exposed to the outside of the cold water tank.

9. The cold water tank assembly of claim 8, wherein the body comprises:

an inner cylinder configured to accommodate the evaporator and the partition wall; and an outer cylinder configured to surround the inner cylinder and form a space.

10. The cold water tank assembly of claim 8, wherein the body has:

a circular cross-section, or a cross-sectional shape of a closed surface having a long axis in the first direction and a short axis in the second direction orthogonal to the first direction.

11. The cold water tank assembly of claim 8, wherein the extension line is formed longer than the radius of the second spiral of the partition so that it is exposed to the outside of the cold water tank.

12. The cold water tank assembly of claim 8, wherein the pitch of the spiral tube is configured to be equal to the pitch of the partition.

13. The cold water tank assembly of claim 8, wherein the cap comprises:

a first hole into which a first flange fused to the spiral shaft tube is fitted, and a second hole into which a second flange fused to the spiral tube is fitted, and wherein the first flange and the second flange further include a seal along a side in contact with the cap.

14. The cold water tank assembly of claim 8, wherein part or all of the partition is formed of a soft material, and the end edge is disposed to press the inner circumferential surface of the accommodation space of the body.

15. The cold water tank assembly of claim 8, wherein the cap comprises:

a plate body having a size enough to cover the entrance of the body;

a first wall protruding downward in the third direction so that a part of the plate body is in contact with an upper inner circumferential surface of the body; and a second wall protruding downward in the third direction so that another part of the plate body is spaced apart from the first wall and is in contact with an upper outer circumferential surface of the body part.

16. The cold water tank assembly of claim 15, wherein the cap is coupled to seal the entrance of the body in the third direction, wherein the first wall, the upper end edge, and the second wall form a sealing space therebetween, and wherein a packing member is provided in the sealing space.

17. The cold water tank assembly of claim 15, wherein the plate body forms a convex round surface upward in the third direction.

18. The cold water tank assembly of claim 15, wherein the cap further comprises a temperature sensor passing through and hermetically coupled to the plate body, and wherein the temperature sensor has a length and is arranged to pass through a predetermined number of the partitions from the top of the body to downward in the third direction.

19. The cold water tank assembly of claim 8, wherein the cap comprises the inlet pipe through which purified water at room temperature flows in, the inlet pipe configured to communicate with the first heat exchange chamber of the accommodation space, and wherein the body comprises the outlet pipe that communicates the 소 last heat exchange chamber of the accommodation space and extracts purified water at low-temperature.

20. The cold water tank assembly of claim 8, wherein the spiral tube is arranged so that a first distance from a partition placed at a lower portion of the heat exchange chamber is equal to or smaller than a second distance from a partition placed at an upper portion of the heat exchange chamber.

* * * * *